United States Patent [19]

Snelling

[11] Patent Number: 4,833,503

[45] Date of Patent: May 23, 1989

[54] ELECTRONIC COLOR PRINTING SYSTEM WITH SONIC TONER RELEASE DEVELOPMENT

[75] Inventor: Christopher Snelling, Penfield, N.Y.

[73] Assignee: Xerox Corporation, Stamford, Conn.

[21] Appl. No.: 137,999

[22] Filed: Dec. 28, 1987

[51] Int. Cl.[4] ..... G03G 15/01

[52] U.S. Cl. ..... 355/259; 355/326; 118/653; 310/800

[58] Field of Search ..... 355/300, 4; 118/645, 118/653; 430/45, 102, 120; 310/800

[56] References Cited

U.S. PATENT DOCUMENTS

| | | | |
|---|---|---|---|
| 3,140,199 | 7/1964 | York | 118/653 X |
| 4,111,546 | 9/1978 | Maret | 355/15 |
| 4,365,549 | 12/1982 | Fotland et al. | 101/1 |
| 4,403,848 | 9/1983 | Snelling | 355/4 |
| 4,546,722 | 10/1985 | Toda et al. | 118/657 |
| 4,647,181 | 3/1987 | Kohyama et al. | 355/4 |

FOREIGN PATENT DOCUMENTS 61-176960 8/1986 Japan .

*Primary Examiner*—A. T. Grimley
*Assistant Examiner*—J. Pendegrass
*Attorney, Agent, or Firm*—William A. Lenny, II

[57] ABSTRACT

A multi-color printer using a sonic toner release development system to provide either partial or full color copies with minimal degradation of developed toner patterns by subsequent over-development with additional colors and minimal back contamination of developer materials. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. After developing of the last color image, the composite color image is transferred to a copy sheet. Development is accomplished by vibrating the surface of a toner carrying member and thereby reducing the net force of adhesion of toner to the surface of the toner carrying member.

2 Claims, 4 Drawing Sheets

30
27
20
CHARGE
26

15
20
EXPOSE

20
DEVELOP 16
20
EXPOSE

20
DEVELOP 41
42
20
TRANSFER

ELECTRONIC COLOR PRINTING SYSTEM WITH SONIC TONER RELEASE DEVELOPMENT

The invention relates to electronic copying/printing systems and more particularly to an electronic multi-color copying/printing system that employs non-interactive development.

In typical xerographic type color copiers, processing of the color copies is done in sequence. For example, in one well known commercial copier, a blue color separation image is first made, developed with yellow toner, and transfrered to a copy sheet which is supported on a rotating drum synchronized to the copying process. Then, a second green color separation image is made, developed with magenta toner, and transferred to the copy sheet in superimposed registered relationship with the first color separation image. Lastly, a third red color separation image is made, developed with cyan toner, and transferred to the copy sheet in superimposed registered relationship with the previously transferred blue and green color separation images. The resulting combination of color separation images is thereafter fused to provide a permanent color copy.

As can be appreciated from the above discussion, the color copying process described is relatively slow, requiring approximately three times as much time to process one copy as is required to process a black and white copy. Additionally, great care must be taken to assure exact registration of the several color separation images with one another if a clear and exact copy of the color original is to be made.

Also, another problem with processing color copies is that present development techniques allow cross-color contamination of images or developer materials. A number of developing techniques are available for electrophotographic copying machines, and include a cascade technique, magnetic brush technique, powder cloud technique, jumping technique, and impression technique, to cite a few typical examples for dry type developing techniques. The developers used may comprise a one component system and a two component system.

To summarize the variety of developing techniques, the cascade technique and the magnetic brush technique which are used with a two component system provide a number of advantages including the stability of the developing process, and are actually in use in most copying machines which are commercially available. However, they have certain disadvantages. Considering the magnetic brush technique by way of example, the developer used with this technique comprises a toner and a carrier, and any change in the proportion of mixture thereof results in an adverse influence upon the optical density of the resulting image.

Considering the developing technique which is used with a single component developer, the powder cloud technique and the impression technique involve a disadvantage that during the developing process, the toner may be deposited not only on an image area, but also on a non-image area of an electrostatic latent image which is formed on a latent image carrying member, resulting in a so-called background fogging which represents a degradation in image quality. The fogging is caused by the absence of a removal force to detach any toner which may be held attracted to a non-image area by induced image charges or by physical influences other than electrostatic attraction.

A development apparatus having a toner carrying member and a piezoelectric vibrator for displacing toner from the toner carrying member and causing it to fly in a manner to avoid depositing toner onto a non-image area of an image bearing surface is disclosed in U.S. Pat. No. 4,546,722 in order to prevent degradation of the charged image for the purpose of image preservation. The apparatus avoids adverse influences upon the electrostatic latent image so as not to cause disturbance in the resulting image if applied in a multiple copy per exposure process to produce a plurality of copies. This apparatus is non-interactive from a latent electrostatic image preservation standpoint, but does not appear to be noninteractive from a developed toner image standpoint, and therefore, would seem to allow unwanted scavaging of multi-colored toner to occur. This apparatus seems to be designed to prevent degradaton of the charged image for the purpose of latent image preservation and not for the purpose of preventing degradation of the toned image pattern.

As is apparent, a need exists for an improved development process from a toner deposition standpoint that is cheap, easy to implement and effective. Accordingly, a non-interactive system for producing color copies is disclosed that prevents degradation of a developed toner pattern by subsequent over-development with additional colors, if desired, and prevents back contamination of developer and comprises in combination, a movable photoreceptor; means to uniformly charge the photoreceptor in preparation for imaging; a beam of high intensity radiation impinging on the photoreceptor at a point downstream of the charging means; means for scanning the beam across the photoreceptor modulating means to modulate the first beam in accordance with first color image signals as the beam is scanned across the photoreceptor whereby to selectively reduce the charge on the photoreceptor and create a first color latent electrostatic image on the photoreceptor; first sonic toner release color developing means for developing the first color image; at least one additional beam of high intensity radiation impinging on the photoreceptor at a point downstream of the first color developing means; means for scanning the additional beam across the photoreceptor; modulating means to modulate additional beam in accordance with second color image signals as the additional beam is scanned across the photoreceptor whereby to selectively reduce the charge on the photoreceptor and create a second color latent electrostatic image on the photoreceptor; second sonic toner release color developing means for developing the second color image; and means for transferring the combined first and second color images to a copy substrate material in a single pass of the photoreceptor.

The above-mentioned features and others of the invention together with the manner of obtaining them will best be understood by making reference to the following specification in conjunction with the accompanying drawings, wherein:

FIG. 1 is an enlarged schematic elevational view showing details of a multi-color printer employing the features of the present invention.

FIGS. 2*a*–2*f* are enlarged views of a photoreceptor section showing details of the additive color process employed by the multi-color printer of FIG. 1.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
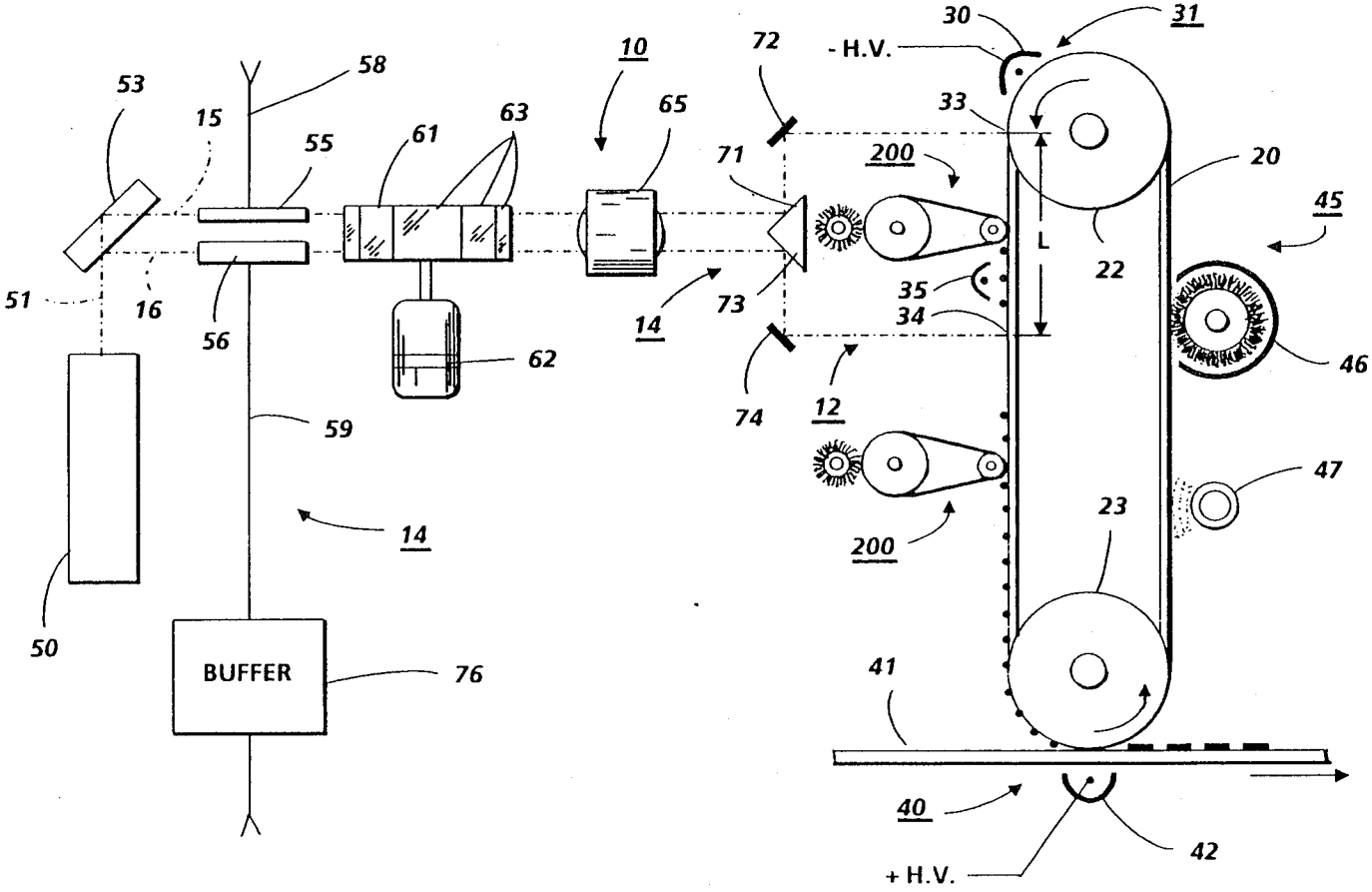

For a general understanding of the features of the present invention, reference is had to the drawings. In the drawings, like reference numerals have been used throughout to designate identical elements. FIG. 1 schematically depicts the various components of an illustrative electrophotographic copying machine incorporating the sonic toner release development apparatus of the present invention therein.

Referring particularly to FIGS. 1 and 2 of the drawings, there is shown the multi-color printer 10, as disclosed in U.S. Pat. No. 4,403,848 which is incorporated herein by reference, that employs the improved developer apparatus of the present invention. Printer 10 includes a xerographic processing section 12 and an image scanning or writing section 14, the latter serving to scan at least two high intensity imaging beams of electromagnetic radiation 15, 16 across photoreceptor 20 of xerographic section 12 to provide at least a dual color image as will appear herein.

Xerographic processing section 12 includes a photoreceptor 20 illustrated herein in the form of an endless belt stretched across drive and idler belt support rollers 22, 23 respectively. Belt supporting rollers 22, 23 are rotatably mounted in predetermined fixed position by suitable means (not shown). Roller 23 is driven from a suitable drive motor (not shown) to move photoreceptor 20 in the direction shown by the solid line arrow. While photoreceptor 20 is illustrated in the form of an endless belt, other photoreceptor configurations such as a drum may be envisioned.

Figures 2A, 2B, 2C, 2D, 2E, 2F:
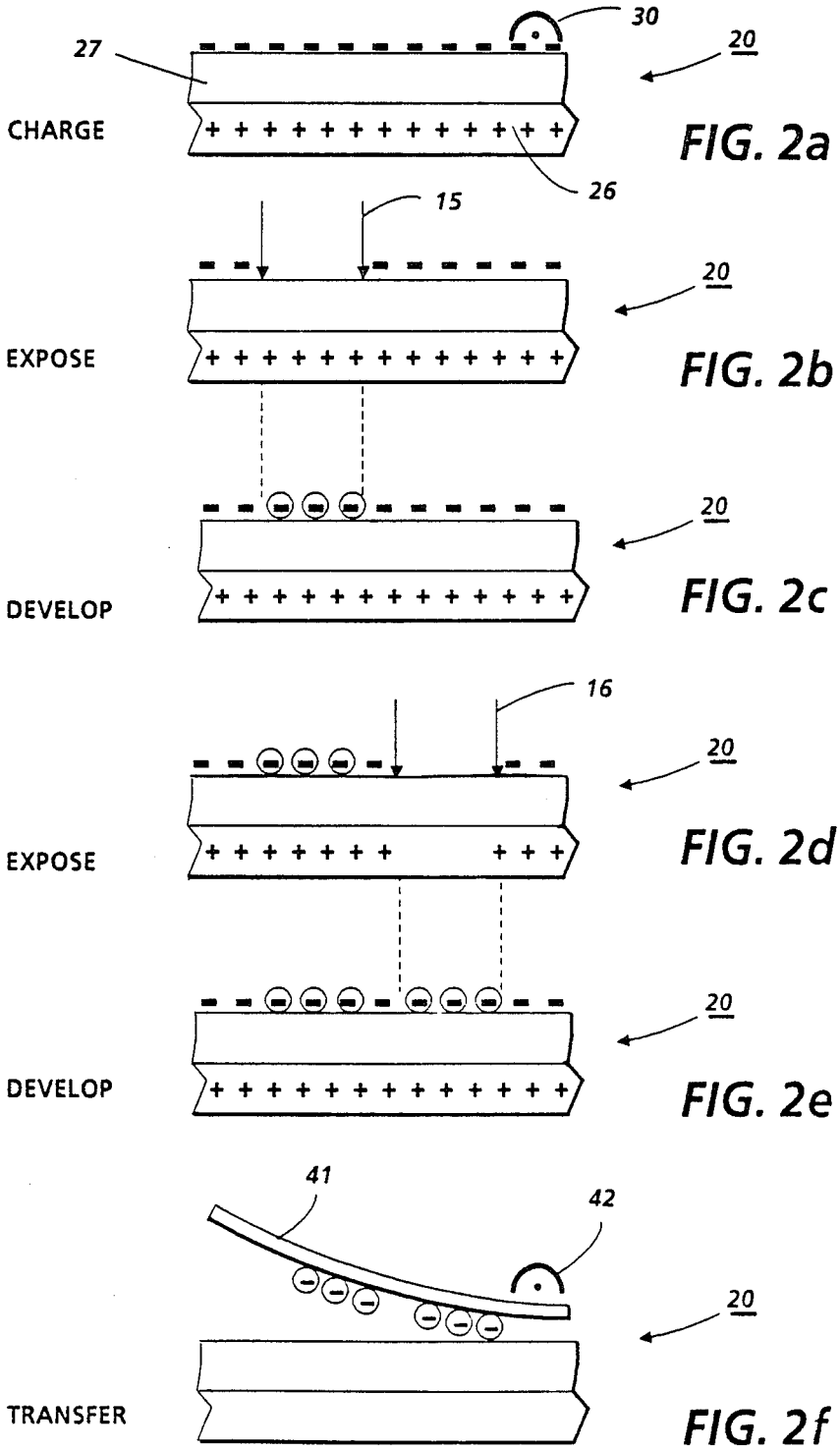

Referring particularly to FIG. 2*a*, photoreceptor 20 comprises an inner layer or substrate 26 composed of a suitable flexible electrically conductive substrate with an outer photoconductive layer 27 such as selenium thereupon. Photoreceptor 20 may be opaque, that is, impervious to electromagnetic radiation such as light, or wholly or partially transparent. The exemplary photoreceptor 20 typically has an aluminum substrate which renders the photoreceptor opaque. However, other substrate materials such as glass may be contemplated which would render photoreceptor 20 wholly or partially transparent. And photoreceptor materials other than selenium as for example organic may also be contemplated. One organic type material for example consists of an aluminized Myler substrate having a layer of selenium dispersed in poly-N-vinyl carbazole with a transparent polymer overcoating containing a charge transport compound such as pyrene.

Referring again particularly to FIG. 1, a corona charging device 30 commonly known as a corotron is operatively disposed adjacent photoreceptor 20 at charging station 31. Corotron 30 which is coupled to a suitable negative high voltage source (−Hv) serves to place a uniform negative charge on photoreceptor 20 in preparation for imaging.

Imaging beams 15, 16 impinge or contact photoreceptor 20 at exposure points 33, 34 respectively, the exposure point 34 of beam 16 being spaced a predetermined distance (L) downstream from the of the contact points 33, 34 of imaging beams 15, 16. Developers 200 each include a suitable developer housing (not shown) within which a supply of color developing material is provided together with means for loading the color developing material onto the developer's magnetic brush roll.

As will be understood by those skilled in the xerographic arts, the color developing material normally consists of a suitable carrier material with relatively smaller color material (referred to as toner). As described hereinafter, toner is drawn to the latent electrostatic images formed on photoreceptor 20 by imaging beams 15, 16 in proportion to the image charge levels to develop the images. In the present arrangement, a discharge development system is used wherein, following negative charging of photoreceptor 20 by corotron 30, image areas are discharged by beams 15, 16 in accordance with image signals. The developing toner is negatively charged and is therefore attracted to the discharged image areas while being repelled from the undischarged non-image areas.

It will be understood that the developing materials and particularly the toner is selected to provide the color image desired. For example, in the two developer arrangement disclosed in FIG. 1, the first developer apparatus 200 in the process direction utilizes a red toner, while the second developer apparatus 200 utilizes a black toner. In that example, the developed image would be composed or red and black image areas in accordance with the particular colored image patterns generated by imaging beams 15, 16. Other color combinations may of course be envisioned. One type of toner found particularly suitable for use herein consists of toner materials that are transparent to electromagnetic radiation. As will appear, this type of toner permits subsequent imaging to be effected through previously developed toner images as when forming a second or third color separation image. Another type of toner could be suspended in a liquid carrier material. Also, it is possible to enhance the process by introducing an additional charging unit 35 prior to subsequent exposure(s) to enhance uniformity of the photoreceptor potential, i.e., neutralize the potential of the previous image.

To eliminate or reduce contamination or cross-mixing of toner, developer apparatus 200 includes means for agitating toner in close proximity to a development nip formed between developer apparatus 200 and photoreceptor 20 which makes for non-interactive development of different toners which will be discussed in more detail hereinafter.

Following development of the electrostatic image created on photoreceptor 20 by colored developers, the developed image is transferred to a suitable copy substrate material 41 such as paper at transfer station 40. To facilitate transfer, a transfer corotron 42 which is coupled to a high voltage power source (+Hv) is provided to attract the developed image on photoreceptor 20 to copy substrate material 41. Following transfer, the developed image is fixed as by a fuser (not shown). Any residual charges and/or developing material left on photoreceptor 20 are removed at cleaning station 45 by erase lamp 47 and cleaning brush 46 respectively.

Image scanning section 14 includes a suitable source of high intensity electromagnetic radiation exemplified herein by laser 50. The beam of light 51 generated by laser 50 is separated into imaging beams 15, 16 by suitable means such as mirror 53. The pair of beams reflected from mirror 53 pass through individual beam modulators 55, 56 which serve to modulate the intensity of the imaging beams 15, 16 in response to image signals input thereto through signal lines 58, 59. Modulators 55, 56 may comprise any suitable type of modulator such as an acousto optic type modulator. The image signals in lines 58, 59 may be derived from any suitable source such as an image input scanner, memory, communication channel, and the like.

From modulators 55, 56 the imaging beams 15, 16 strike a suitable scanning element shown here as rotating polygon 61. Polygon 61 is rotated by motor 62 in synchronism with movement of photoreceptor 20 and at a speed sufficient to scan imaging beams 15, 16 across photoreceptor 20 without noticeable distortion. A suitable lens 65 serves to focus the imaging beams 15, 16 reflected from the mirrored facets 63 of polygon 61 onto photoreceptor 20.

As described heretofore, imaging beams 15, 16 impinge on photoreceptor 20 at exposure points 33, 34 respectively which are spaced a predetermined distance L from one another along photoreceptor 20, the distance L being chosen to accommodate the color developer. To provide the requisite spacing L between exposure points 33, 34, mirror pairs 71, 72 and 73, 74 are provided to re-route imaging beams 15, 16 mirrors 71, 73 serving to first turn beams 15, 16 in an outward direction substantially paralleling the path of movement of photoreceptor 20 with mirrors 72,74 serving to restore beams 15, 16 to a direction which will intersect photoreceptor 20 at exposure points 33, 34 respectively. Mirrors 72, 74 as will be understood, are spaced apart by the distance L in the exemplary arrangement shown.

To accommodate the exposure delay due to spacing of the second imaging beam downstream of the first imaging beam and to assure registration of the second color image with the first color image, a suitable image signal delay device such as buffer 76 is provided in the image signal input line 59 to modulator 56. Buffer 76 is chosen to delay input of the image signals to modulator 56 by an interval sufficient to register the second color image with the first color image.

While imaging beams 15, 16 are illustrated as impinging on the exterior of photoreceptor 20, it will be understood that in the case where photoreceptor is transparent or partially transparent, imaging beam 16 and if desired imaging beam 15 may be disposed to impinge against the interior of photoreceptor 20.

Figure 3:
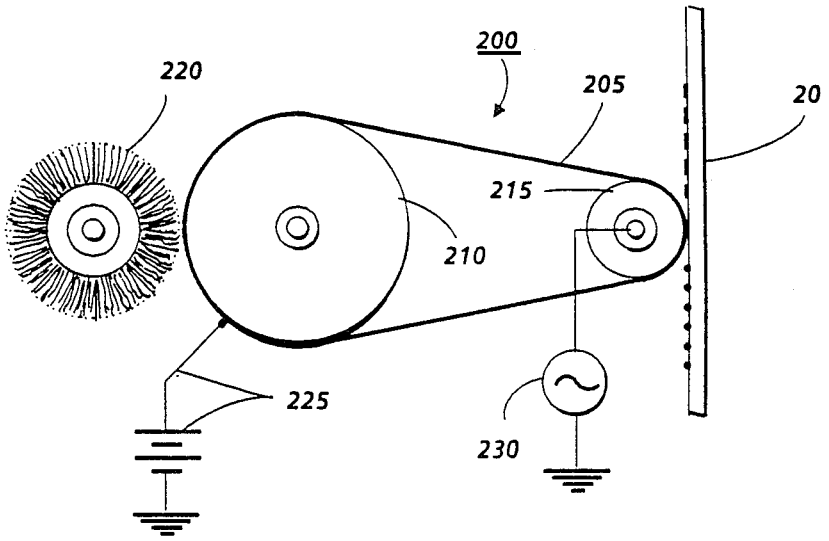
FIG. 3 is an enlarged elevational view of the non-interactive developer apparatus of the present invention.

Turning now to FIG. 3 and the present invention, an enlarged development apparatus 200 is shown that accomplishes sonic toner release in a *non-interactive development* process having minimal interactive effects between deposited (developed) toner and subsequently presented toner. The development apparatus 200 is a means to achieve multicolor single transfer systems without cross-color contamination of images and/or developer materials (scavanging effects). The development apparatus 200 is typical of developing apparatuses of the present invention and comprises a peizoelectric polymer belt 205 as a doner member having a portion thereof closely spaced with respect to photoreceptor 20 in what is commonly known as touchdown development. The peizoelectric belt 205 is entrained around spaced rollers 210 and 215. Roller 210 is the driver and is positioned adjacent a magnetic brush toner loading device 220. Belt 205 has a grounded D.C. bias applied to its outside surface by source 225. The outside surface of the belt includes a conductive coating thereon. A grounded A.C. source 230 applies a bias to idler roller 215. Thus, the basic concept of sonic toner release is achieved by reducing the net force of adhesion of toner to the loaded donor surface by acoustic agitation of the doner surface by A.C. source 230. Sufficient reduction of the net force of adhesion of toner to the doner surface enables $_qE$ electrostatic forces to selectively remove toner from the donor and transport it to desired areas of development on the receptor.

In sonic toner release development, use is made of motions of a charged particle bearing surface (donor) to controllably counter forces adhering the particles to the surface. These motions can be adjusted in magnitude such that particles continue to adhere to the donor surface unless they are additionally effected by an electric field of appropriate direction and magnitude to remove them from the donor. In the case where the electric field is due to proximity of an electrostatic image, the released toner will selectively traverse to the image, thereby developing it.

The selective toner removal characteristics of sonic toner release development distinguish it from powder cloud (and jumping) development where airborne toner is presented to the entire receptor regardless of it's potential. This distinction provides an important copy quality advantage with sonic toner release since wrong sign and non-charged toner deposition is inhibited. In addition, interaction effects between successive developments with different toners (colors) are minimal. Development system advantages obtained with single transfer and enabled by noninteractive development include simplified (on the receptor) registration of images, increased thruput, and reduced system complexity.

Figure 4:
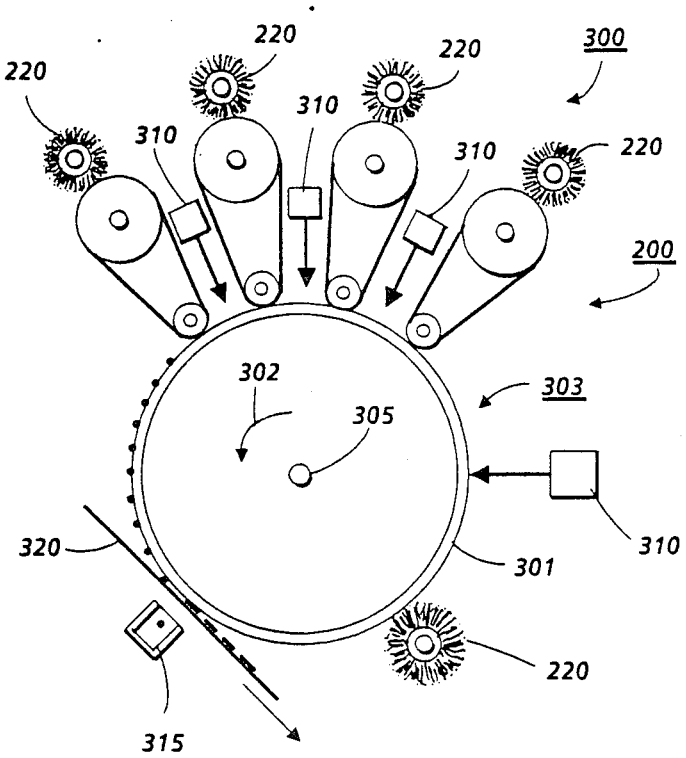
FIG. 4 is an enlarged elevational view of the non-interactive developer apparatus of the present invention employed in an ionographic type printing machine.

An alternative configuration that employs the sonic toner release process and apparatus 200 is shown in FIG. 4 in the form of a conventional electrostatic printer 300 that uses a plurality of conventional ion generating devices 310 as disclosed in U.S. Pat. No. 4,369,549 which is incorporated herein by reference. Each ion generator places a latent electrostatic image on dielectric surface 301 of drum 303 for sequential development. Drum 303 is mounted for rotation about shaft 305 in the direction of arrow 302. Each latent image is then toned by charged colored particulate matter or toner at the four different development stations shown. The sequential deposition of toner could be magenta, cyan, yellow and black. Following toning, the image is transferred to a copy sheet 320 by transfer corotron 315.

Figure 5:
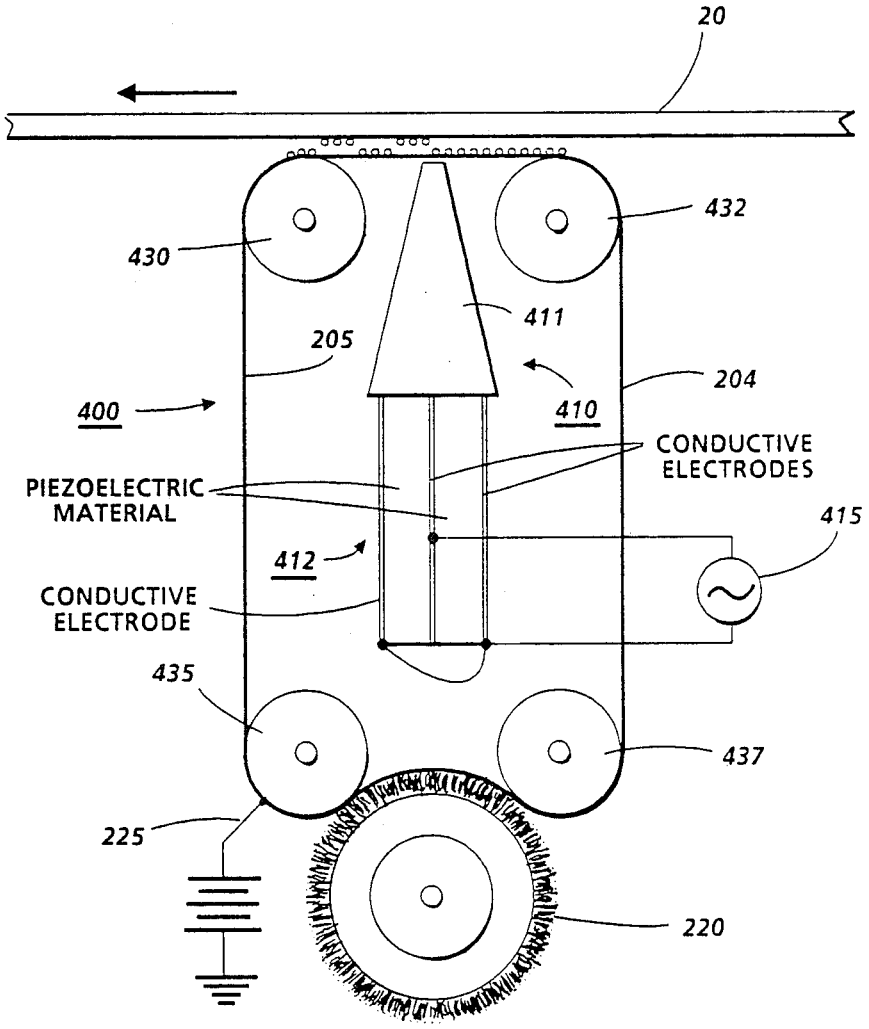
FIG. 5 is an alternative embodiment of a non-interactive development apparatus in accordance with the present invention.

In another embodiment of the present invention shown in Figure 5, a development apparatus 400 accomplishes sonic toner release by the use of an acoustic assembly 410 that comprises a piezoelectric material 412 that is comprised of lead titanate, barium titanate or other ceramic material and a horn 411 that can be made of brass. The piezoelectric material 412 has an A.C. bias source 415 connected to it that supplies about 60 kHz energy in order to vibrate the horn 411. Horn 411 is positioned adjacent and within the run of belt 205 that is entrained around drive roller 430, a rubber damping roll 432 and two idler rolls 435 and 437. Belt 205 has an aluminized outer surface 204 and a D. C. bias 225 applied thereto for development purposes and is loaded with toner by magnetic brush 220. The toner is loosened from the surface of film 204 by the vibration of acoustic horn 411 which in turn vibrates belt 205 and the surface of film 204. The then loosened toner will migrate to and only to charged or desired image areas of photoconductor 20.

It should now be apparent that a process and apparatus has been disclosed that includes loosening charged toner from a donor member by sonic agitation of the donor member. Loosening of the toner reduces the net forces holding the particles to the doner member. Toner stays on the surface of the donor member unless there is an image field adjacent to the donor member to extract it, thereby making the apparatus and process non-scavenging and non-interactive. While the embodiments of this invention have been described with reference to a printer that includes a laser generated image source, it should be understood that the invention works equally as well with a light lens system as employed in conventional copiers and duplicators.

What is claimed is:

1. A non-interactive color developing apparatus that has minimal interaction effects between deposited toner and subsequently presented toner adapted to achieve multicolor single transfer of images without cross-color contamination of images and/or developer materials, comprising:

a plurality of toner carrying piezoelectric polymer belts for conveying toner from respective developer vessels to a location adjacent to an electrostatic latent image carrying member, said plurality of toner carrying piezoelectric polymer belts being positioned with predetermined spacing with respect to said latent image carrying member; and grounded A.C. biased rollers for vibrating the toner carrying surface of said toner carrying piezoelectric polymer belts adjacent an area of said electrostatic latent image carrying member that is to be developed, and wherein said A.C. biased rollers cause said piezoelectric polymer belts to vibrate only in said area adjacent said electrostatic latent image carrying member in order to loosen toner on the surface thereof, but not release the toner unless an image field is present to thereby enhance the electrostatically drawing of the toner over to the image carrying surface of said electrostatic latent image carrying member.

2. A developing apparatus for developing an image on a photosensitive member in a printing machine, comprising:

at least one toner applying means;

at least one piezoelectric polymer belt with a conductive coating thereon supportedly positioned adjacent said photosensitive member and adapted to receive toner from said at least one toner applying means and present the toner to the image carrying surface of said photosensitive member, said at least one piezoelectric polymer belt being grounded with a D.C. bias applied thereto; and a grounded A.C. biased roller, said piezoelectric polymer belt covering a radial portion of said A.C. biased roller adjacent an area of said photosensitive member that is to be developed, and wherein said A.C. biased roller causes said piezoelectric polymer belt to vibrate in said area adjacent said photosensitive member in order to loosen toner on the surface thereof, but not release the toner unless an image field is present to thereby enhance the electrostatically drawing of the toner over to the image carrying surface of said photosensitive member.

* * * * *